United States Patent [19]

Vanderjagt

[11] Patent Number: 4,804,109

[45] Date of Patent: Feb. 14, 1989

[54] RETURNABLE CONTAINER SYSTEM

[76] Inventor: John A. Vanderjagt, 1395 Glen Oaks Dr., Memphis, Tenn. 38117

[21] Appl. No.: 132,176

[22] Filed: Dec. 14, 1987

[51] Int. Cl.[4] ..... B65D 88/54

[52] U.S. Cl. ..... 222/38; 222/333; 222/385; 417/415

[58] Field of Search ..... 222/36, 38, 382, 383, 222/385, 372, 464, 333, 334; 92/128; 417/360, 415

[56] References Cited

U.S. PATENT DOCUMENTS

| | | | |
|---|---|---|---|
| 1,896,056 | 1/1933 | Pepper | 222/38 |
| 1,913,062 | 6/1933 | Wheeler | 222/38 X |
| 1,929,291 | 10/1933 | Spaeth | 222/38 X |
| 2,431,534 | 11/1947 | Benner | 222/383 |
| 2,779,509 | 1/1957 | Allen | 222/385 X |
| 3,184,124 | 5/1965 | Beck | 222/385 X |
| 3,207,378 | 9/1965 | Trumbull et al. | 222/385 X |
| 4,570,833 | 2/1986 | Vanderjagt | 222/333 |

*Primary Examiner*—Kevin P. Shaver

*Attorney, Agent, or Firm*—Walker & McKenzie

[57] ABSTRACT

A returnable container system for containing and dispensing liquid chemicals and the like. The system has a drivable reciprocatable pump and a one-way check valve in the suction tube of the system. An attachable assembly unit is provided which includes a rod extension that is reciprocatably driven by a motor and is attachable to the pump rod for the drive of the pump and which includes a counter for indicating the amount of chemicals dispensed from the container. The container system gives the user the option of using the system in a first condition in which the assembly unit is attached or in a second condition in which the assembly unit is detached and the user uses his own separate pump but utilizes the one-way check valve in the suction tube.

11 Claims, 4 Drawing Sheets

RETURNABLE CONTAINER SYSTEM

BACKGROUND OF THE INVENTION

1. Field of the Invention

The present invention relates to a returnable container system for liquid chemicals and the like.

2. Description of the Related Art

Heretofore, returnable container systems comprised in general a container for containing the liquid chemicals and the like, a suction tube extending down into the interior of the container, a one-way valve in the suction tube to allow the chemicals to be drawn out of the container, but preventing any return of chemicals or contamination into the container, and sealing means to guard against unauthorized entry by the user into the container prior to return of the container to the chemical company to be refilled. Thus, with returnable containers, as above described, the chemical company could rest assured that the containers would not be returned contaminated. However, with the prior systems above described, for the user, such as a farmer using the chemicals to spray his crops, it was necessary for him to own a separate pump and measuring device for dispensing a measured amount of chemicals received from the suction tube of the container. Consequently, by having his own pump and measuring device, the danger to the user of being exposed to the poisonous or hazardous chemicals or the like was increased, for example, during the cleaning of the pump and the metering device.

SUMMARY OF THE INVENTION

The present invention is directed toward providing an improved returnable container system for liquid chemicals and the like which gives an option to the user to use the system in a first condition or a second condition. The concept of the present invention is to provide in the elongated housing or suction tube a drivable reciprocatable pump means in addition to the one-way check valve and to provide an attachable assembly unit including pump drive means for reciprocatably driving the pump means and with the unit including counter means operably connected to the pump driving means for indicating measured amounts of chemicals and the like dispensed from the container. With the system of the present invention, it can be used in a first condition, that is, with the assembly unit attached or in a second condition in which the assembly unit is detached. Thus, the user may elect to own an assembly unit without having to pay for the pump and at the same time, he would receive the benefits of not being exposed to the poisonous or hazardous chemicals and the like, as for example, when the pump was cleaned. On the other hand, if the user already had a pump and measuring device and did not desire to purchase the above mentioned assembly unit, the system could be used in the said second condition, that is, without the above mentioned assembly unit. In either case, the chemical company would be assured of receiving back the uncontaminated container for refilling after use.

One of the objects of the present invention is to provide an improved returnable container system in which the users of the system will not become exposed to the chemicals unnecessarily.

A further object is to provide such a system wherein the containers are not contaminated when returned after use.

A further object is to provide such a system which contains a drivable pump means disposed in the elongated housing or the suction tube so that the system can be optionally used with a pump driving and counter means assembly unit for dispensing and indicating measured amounts of chemicals dispensed from the container.

DESCRIPTION OF THE PREFERRED EMBODIMENT

Figure 1:
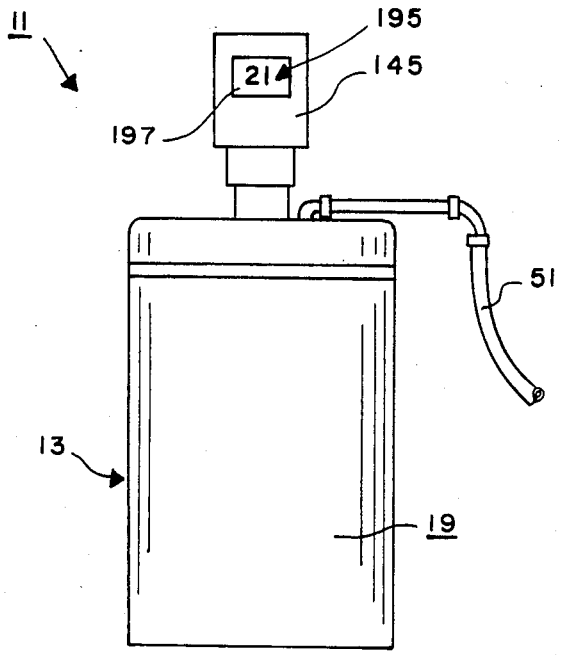
FIG. 1 is a side elevational view of the returnable container system of the present invention.

The returnable container system 11 of the present invention includes, in general, a container 13 for holding the liquid chemicals L and the like, dispensing means 15 for dispensing chemicals L and the like from container 13, and an assembly unit 17.

The container 13 is enclosed by a wall 19 including cylindrical side wall 21, a bottom wall 23 integrally attached to the lower edge of cylindrical wall 21, and a top wall 25 integrally attached to the upper edge of cylindrical wall 21. Wall 19 encloses and defines the interior 27 of the container 13 in which the liquid chemicals L and the like is contained. The container 13 is preferably formed of any material suitable for reuse and for containing the chemicals L. Top wall 25 is provided with an opening 29 preferably centrally of the top wall. Container 13 includes a hollow neck portion 31 surrounding opening 29. Neck portion 31 is preferably integrally attached to top wall 25 and is upstanding therefrom. Neck portion 31 has an outwardly extending flange 33 at the upper end 35 of neck portion 31.

Dispensing means 15 includes in general a suction tube or elongated housing 37, a one-way check valve 39, and drivable pump means 41.

Housing 37 includes an outlet 43 extending through an opening 45 in the top 47 of the housing to the exterior thereof. Housing 37 also includes an interior passageway 49 for chemicals L and the like to flow therethrough from the interior 27 of container 13 to outlet 43 and a conduit 51 attached to the outlet for the dispensing of the liquid chemicals L to the desired dispensing area.

Figure 4:
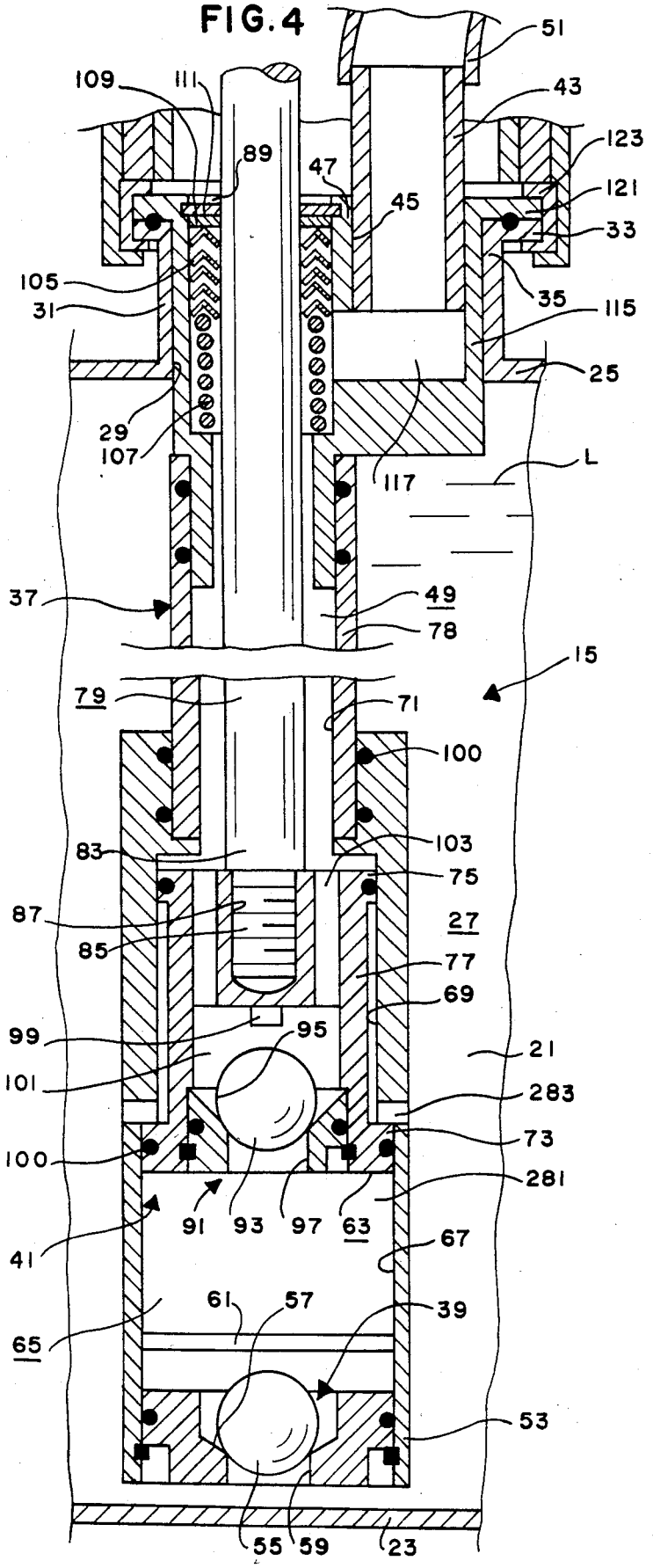
FIG. 4 is a enlarged fragmentary sectional view taken as on a vertical plane through a portion of the dispensing means of the present invention showing a fragmentary portion of the assembly unit in an attached position relative to the container.

One-way check valve 39 is preferably disposed in the lower end 53 of housing 37 and preferably includes a ball 55, a valve seat 57, an inlet 59 which is part of passageway 49, and a stop member 61 positioned in spaced relationship above ball 55 to limit upward movement of the ball 55 in the open position. Stop 61 is preferably in the form of a narrow plate or bar which is attached at the opposite ends thereof to housing 37. In FIG. 4 the valve 39 is shown in a closed position. It will be understood that valve 39 permits flow of chemicals and the like from the interior 27 of container 13 into passageway 49, but prevents flow from the passageway 49 into the interior 27 of container 13.

Drivable pump means 41 is disposed in housing 37 and is of the double acting reciprocatable type. Thus, pump means 41 includes a reciprocatable piston 63 slidably disposed in the lower interior 65 of housing 37. The lower interior 65 is preferably of two different diameters to provide an enlarged lower interior 67 and an intermediate lower interior 69. Upwardly from intermediate lower interior 69 the interior of housing 37 is reduced to provide a reduced interior 71. More specifically, the lower end portion 73 of piston 63 is slidably mounted in enlarged lower interior 67 and the upper end portion 75 of piston 63 is slidably mounted in intermediate lower interior 69 with the midportion 77 of piston 63 being spaced from the wall 78 of housing 37.

Pump means 41 also includes a piston rod 79 having an upper end 81 and a lower end 83. Piston rod 79 is attached at the lower end 83 thereof to piston 63 by suitable means as by a reduced threaded portion 85 of rod 79 being threadedly engaged in a threaded socket 87 provided in the upper end of piston 63. Piston rod 79 extends upwardly through an opening 89 in the top 47 of housing 37 with the upper end 81 of piston rod 79 being on the exterior of container 13.

in addition, pump means 41 includes a check valve 91 in the lower end of piston 63. Check valve 91 preferably includes a ball 93, a seat 95, an inlet 97, and a stop 99 to limit upward movement of ball 93. Pump means 41 is provided with suitable O rings 100.

Piston 63 is provided with an interior chamber 101 and interior passageways 103 leading from interior chamber 101 through the upper end of piston 63.

Surrounding piston rod 79 adjacent hollow neck portion 31 are the following components: chevron packing 105, a spring 107 urging packing 105 upwardly against a washer 109 and a lock ring 111 to hold the components in place.

Piston rod 79 includes first attachment means 113 adjacent upper end 81, which will be described more in detail hereinafter.

The upper end of housing 37 is enlarged to provide an enlarged portion 115 at the upper end of the housing which is offset to one side to accommodate outlet 43 and to provide a laterally extending portion 117 of passageway 49 to communicate a vertical portion of the passageway adjacent piston rod 79, provided by the space between the piston rod 79 and the wall 78 of housing 37, with the lower end of outlet 43. The upper end of housing 37 projects outwardly to provide a flange 121.

Dispensing means 15 is removably mounted in container 13 with flange 121 of housing 37 resting on flange 33 of neck portion 31 of container 13, as best seen in FIG. 4. With dispensing means 15 mounted as above described, housing 37 extends downwardly through the opening 29 to a place adjacent but spaced from the bottom wall 23 of container 13, as best seen in FIG. 4.

Figure 3:
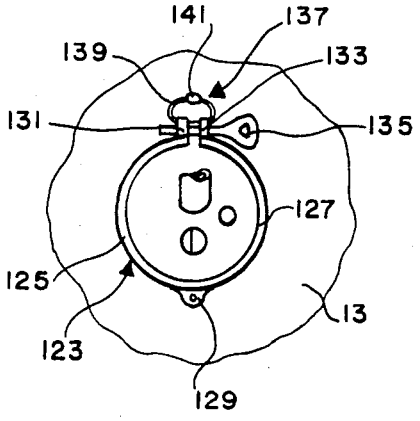
FIG. 3 is a top view of a fragmentary portion of the container with the clamping ring and related structure being shown.

A clamp 123 engages flanges 33 and 121 to secure dispensing means 15 in container 13. Clamp 123 is of a contruction well known to those skilled in the art and includes clamp halves 125, 127 which are C-shaped in cross section and are hingeably attached to one another at the adjacent ends thereof by a hinge 129. The ends of clamp halves 125, 127 which are opposite from the hinge 129 are provided with out turned portions 131, 133 (see FIG. 3) which are internally threaded and receive a thumb screw 135. A sealing means is attached between the out turned portions 131, 133 to prevent unwanted disengagement of clamp 123 from flanges 33, 121. Sealing means 137 is of a contruction well known to those skilled in the art and includes a wire 139 extending through apertures, not shown, respectively in out turned portions 131, 133 and with the ends of wire 139 being joined in sealed relationship by a piece of metal 141 or the like. Thus, if the seal or wire 139 is broken, this indicates to the chemical company or others that the container has been tampered with and could be contaminated.

Assembly unit 17 includes, in general, a pump driving means 143 for reciprocatably driving drivable pump means 41 when operably connected to piston rod 79 and includes counter means 145 operably connected to pump driving means 143 for indicating measured amounts of chemicals L, and the like, dispensed from container 13.

Pump driving means 143 includes a gear housing 147, an electrical motor 149 mounted on gear housing 147 on the exterior thereof by suitable means well known to those skilled in the art and including a rotatably driven shaft 151, a first gear 153 fixedly mounted on shaft 151, a second gear 155 rotatably mounted from gear housing 147 and meshing with first gear 153 for rotation of second gear 155 by the first gear 153, a piston rod extension 159, and connecting means 161 for operably connecting the rotational movement of second gear 155 to piston rod extension 159 to cause piston rod extension 159 and piston rod 79 to reciprocate upwardly and downwardly. Second gear 155 is rotatably mounted on the interior of gear housing 147 by suitable means well known to those skilled in the art, as by being fixed to a stub shaft 163 rotatably mounted in a bearing 165 fixedly attached to gear housing 147 by suitable means well known to those skilled in the art.

Figure 8:
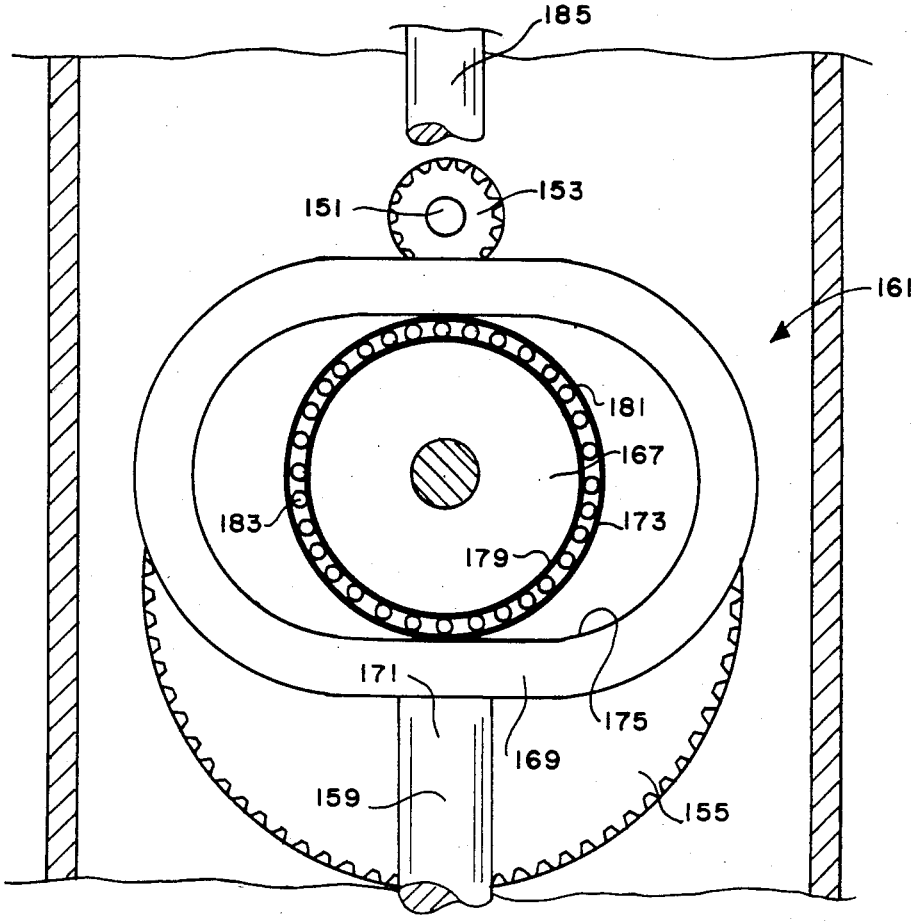
FIG. 8 is a sectional view taken as on line VIII—VIII of FIG. 5.

Connecting means 161 includes a cam 167 attached to second gear 155 at a point spaced from the center of second gear 155, a Yoke 169 attached to piston rod extension 159 at the upper end 171 thereof, a ring bearing 173 interposed between cam 167 and the inner path 175 of yoke 169 for allowing cam 167 to move side-to-side relative to yoke 169 and to cause yoke 169 to move upwardly and downwardly as second gear 155 rotates. More specifically, cam 167 is preferably circular and is fixedly attached to second gear 155 by means well known to those skilled in the art as, for example a pin 177. Pin 177 is in spaced parallel relationship relative to stub shaft 163, as will be best seen in FIG. 5. Yoke 169 is attached to the upper end 171 of piston rod extension 159 by suitable means well known to those skilled in the art as, for example, by welding. The inner path 175 of yoke 169 is preferably oblong in shape as best seen in FIG. 8. Ring bearing 173 preferably includes an inner race 179, an outer race 181 and roller bearings 183. Inner race 179 surrounds the outside of cam 167 and outer race 181 contacts inner path 175, as best seen in FIG. 8.

Figure 5:
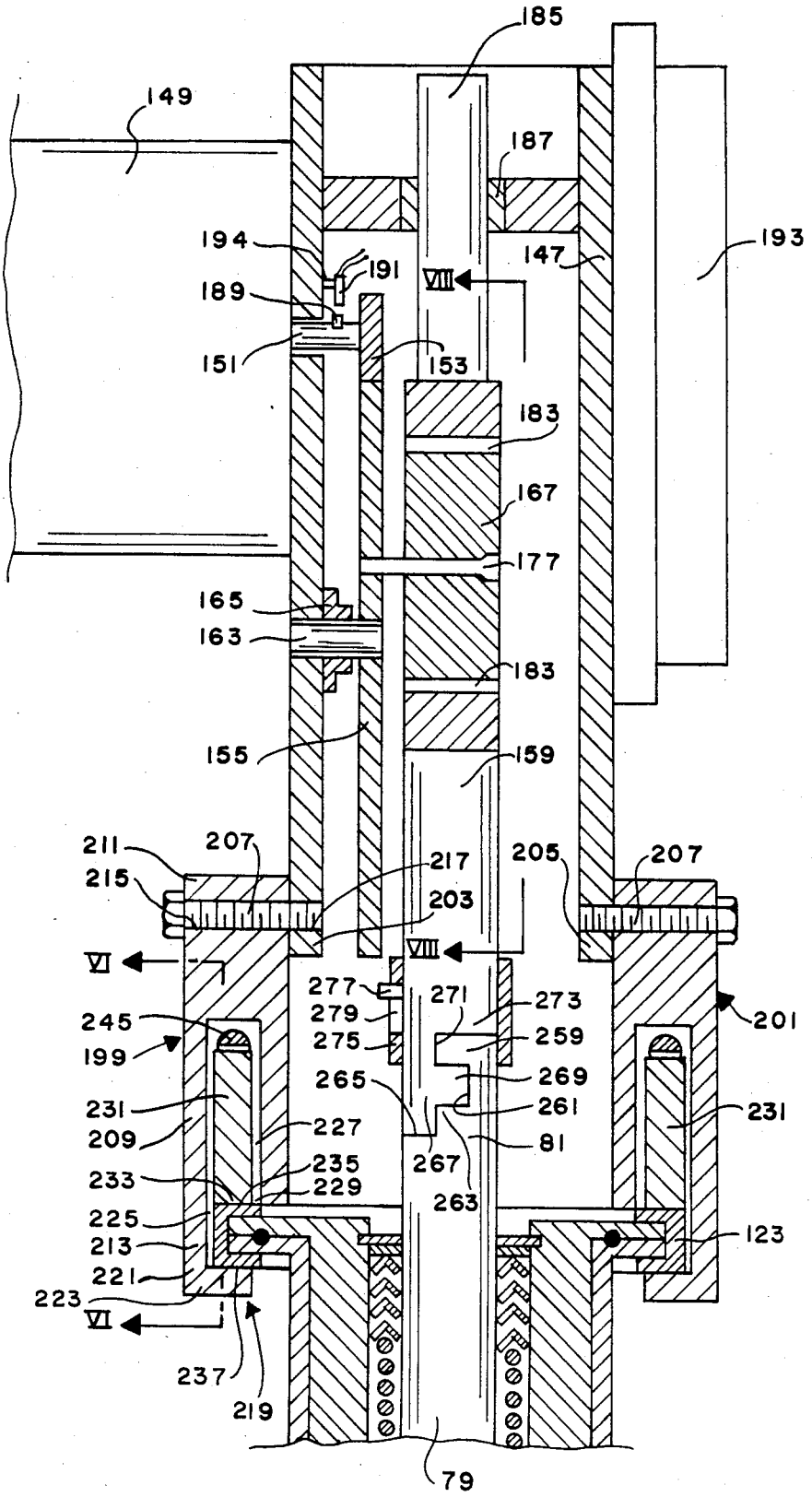
FIG. 5 is an enlarged fragmentary sectional view taken 90 degrees from the plane of FIG. 4 through the upper part of the returnable container system of the present invention showing the assembly unit in an attached position relative to the container.

An additional rod 185 is fixedly attached to the upper end of yoke 169, as best seen in FIG. 5, and extends upwardly therefrom through a bearing 187. Additional rod 185 is aligned longitudinally with piston rod extension 159, that is, the longitudinal axes of piston rod extension 159 and additional rod 185 are in alignment.

Figure 2:
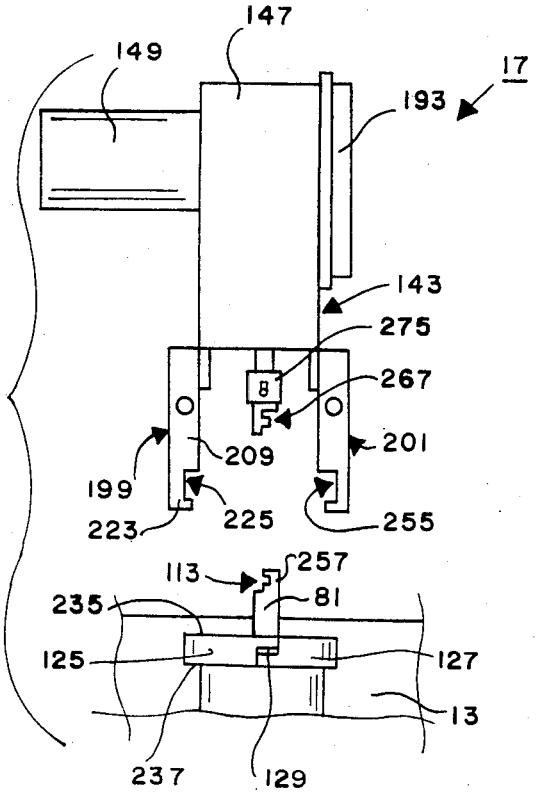
FIG. 2 is an enlarged end elevational view of the assembly unit shown detached from the container and with only a portion of the container and related structure being shown for purposes of illustration.

Counter means 145 includes magnet means 189 fixedly attached to shaft 151 for rotation therewith, reed switch means 191 adjacent magnet means 189 in spaced relationship thereto for being actuated by magnet 189 as shaft 151 is rotated, and electronic digital counter means 193 operably coupled to reed switch means 191 for indicating the amount of chemicals L, and the like, dispensed from container 13. Reed switch means 191, the construction and operation of which is well known to those skilled in the art, is preferably supported from the interior of gear housing 147 by suitable means as bracket 194. Counter means 193 counts the revolutions of shaft 151 which in turn indicates the strokes of pump means 41 and thereby the amount of chemicals L, and the like, dispensed from container 13. Counter means 193, a microprocessor counter with a built-in scaler, is well known to those skilled in the art. An example of such a counter is that manufactured by Durant Division of Eaton Corporation, 901 South 12th Street, Watertown, Wis. 53094. It will be understood that a visual changeable digital indication 195 will appear on the screen 197 of the counter means 193 so that the user will know how many times the shaft 151 rotates and thereby how many times the piston rod 79 reciprocates, which in turn indicates the amount of liquid chemicals L, and the like, which have been dispensed from the container 13. Electronic digital counter means 193 is attached to and supported from gear housing 147 by suitable means well known to those skilled in the art. Counter means 193 is preferably disposed on the opposite side of gear housing 147 from motor 149, as best seen in FIGS. 2 and 5.

Assembly unit 17 includes a pair of supporting means 199, 201 for supporting assembly unit 17 (i.e., pump driving means 143 and counter means 145) and for attaching the assembly unit 17 to container 13. The supporting means 199, 201 are respectively fixedly attached to gear housing 147 adjacent the lower end thereof. The above-mentioned attachment is preferably respectively to the depending portions 203, 205 of gear housing 147 and the attachment is preferably by means of bolts 207, as best seen in FIG. 5.

Supporting means 199 and 201 are substantially identical and the following description of supporting means 199 will suffice for both.

Supporting means 199 includes a body member 209 having an upper end 211 and a lower end 213. It is preferably the upper end 211 that is attached to depending portion 203, as above described, by bolts 207 which extend through apertures 215 (only one of which is shown) in upper end 211 and into threaded apertures 217 (only one of which is shown) in depending portion 203. A foot member 219 is integrally attached to body member 209 adjacent lower end 213. Foot member 219 includes a vertical portion 221 and a lateral foot portion 223 formed integrally at the lower edge of vertical portion 221 and extending right angularly inwardly in spaced relationship beneath body member 209 to provide a mouth 225 (see FIGS. 2 and 5).

Body member 209 has an open interior 227 which opens downwardly through an opening 229 into mouth 225. A locking member 231, preferably in the form of a circular disk, is movably mounted in interior 227 and has a lower portion 233 extendable through opening 229 into mouth 225 (see FIG. 5) Mouth 225 is sized to receive clamp 123 with locking member 231 contacting the upper edge 235 of clamp 123 and the lateral portion 223 of foot member 219 contacting the lower edge 237 of clamp 123. An adjustable wedging means 239 is provided for urging locking member 231 downwardly against clamp 123 to grip clamp 123 between lateral portion 223 and locking member 231.

Figure 6:
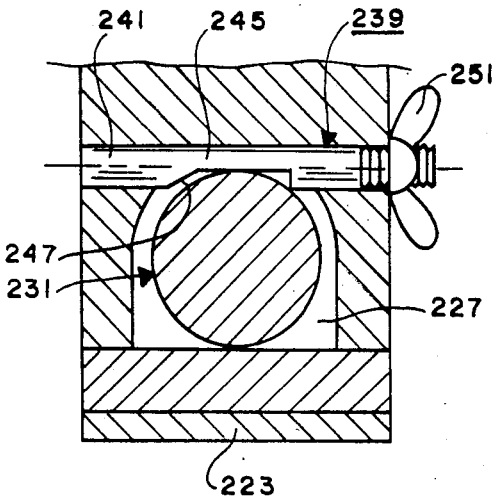
FIG. 6 is a sectional view taken as on line VI—VI of FIG. 5 showing the locking member in an unlocked position.
Figure 7:
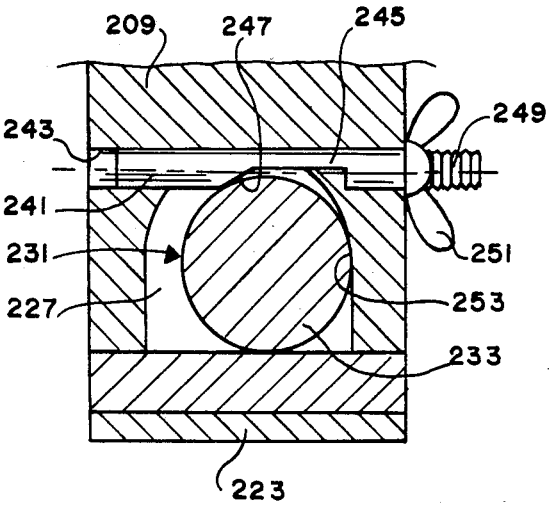
FIG. 7 is a view similar to FIG. 6 but showing the locking member in a locked position.

Wedging means 239 includes a threaded rod 241 extending through a bore 243 in body member 209, which bore 209 is in communication with interior 227 adjacent locking member 231. Rod 241 is cut out in an intermediate portion thereof to provide a narrowed portion 245 and a flat angled surface 247 disposed at an angle relative to the longitudinal axis of rod 241. Rod 241 is threaded on one end thereof as at 249 with the threaded end 249 extending exteriorly of body member 209. Rod 241 is slidably mounted in bore 243 for movement longitudinally between first and second positions. A thumb nut 251 is threadedly engaged on threaded end 249 exteriorly of body member 209 for turning in a first direction to draw rod 241 longitudinally to the right, as viewed in FIGS. 6 and 7, to cause angled surface 247 to exert a force downwardly and to the right, as viewed in these FIGS., against locking member 231. It will be understood that one component of the force exerted, as above described, will be a downward component of force against locking member 231 to lock supporting means 199 on clamp 123. Thumb nut 251 is turnable in a second or opposite direction to release angle surface 247 from locking member 231 to permit removal of supporting means 199 from clamp 123. FIG. 6 shows the rod 241 in said second or unlocked position in which it will be seen that the angled surface 247 has been released from locking member 231, and the narrowed portion 245 permits the locking member 231 to move upwardly so that clamp 123 is no longer gripped by the locking member 231. FIG. 7 shows rod 241 in said first position after turning of the thumb nut 251 in said first direction to cause angled surface 247 to exert a downward component of force against locking member 231 to lock supporting means 199 on clamp 123. Also, it will be seen that in said first position locking member 231 is limited in movement to the right by engagement with wall 253 of body member 209.

Supporting means 199 and 201 are preferably disposed opposite one another on opposite sides of gear housing 147 with the respective mouths 225, 255 thereof facing one another (see FIG. 2).

First attachment means 113 consists of a claw-like member 257 formed in the upper end 81 of piston rod 79 and extending transversely of the piston rod 79. Claw-like member 257 includes a horizontally projecting member 259 and a slot 261 in piston rod 79 below projecting member 259. There is a portion 263 of piston rod 79 which projects below projecting member 259 to establish slot 261. The projecting member 259 and the portion 263 extend substantially halfway across piston rod 79. There is a land 265 adjacent the lower edge of portion 263 which extends across the remaining half of piston rod 79.

A second attachment means 267 is provided on the lower end of piston rod extension 159 and is adapted to mate with first attachment means 113 to detachably connect piston rod extension 159 and piston rod 79 (see FIG. 5). Second attachment 267 includes a projecting member 269 complementary in shape to slot 261 of claw-like member 257. Projecting member 269 is slidably movable laterally into and out of an engaged position in slot Z61. A slot Z71 is provided in piston rod extension 159 adjacent the lower end of piston rod extension 159 above projecting member 269. Slot 271 is complementary in shape to projecting member 259 of claw-like member 257 and is slidably movable laterally into and out of an engaged position over projecting member 259. A sleeve 275 is slidably mounted on lower end 273 of piston rod extension 159. Sleeve 275 is movable between a first position above slot 271 and a second position (see FIG. 5) in overlapping relationship with projecting member 259 when projecting member 259 and slot 271 and projecting member 269 and slot 261 are in said engaged positions. Thus, when sleeve 275 is in said second position, piston rod extension 159 and piston rod 79 are locked together for conjoint movement. Then, when it is desired to unlock piston rod 79 and piston rod extension 159, sleeve 275 is raised to said first position out of engagement with piston rod 79 so that assembly unit 17 may be moved in a direction to carry second attachment means 267 out of engagement with first attachment means 113. At the same time, it will be understood that the supporting means 199, 201 will be moved from an engaged position relative to clamp 123 to a disengaged position. In addition, it will be understood that the mouths 225, 255 and the related parts should be parallel with projecting member 269, slot 271 and the related parts of second attachment means 267 so that the above simultaneous disengagement of assembly unit 17 from container 13 is possible. Then, to re-engage the parts it is necessary for first and second attachment means 113, 267 to be aligned as well as mouths 225, 255 must be aligned with clamp 123. A pin 277 is attached to piston rod extension 159 and extends through a slot 279 in sleeve 275 (see FIG. 5) to limit movement of sleeve 275 in said first and second positions.

in the operation of the returnable container system 11 of the present invention, the user has this option of operating the system in a first condition in which assembly unit 17 is utilized or in a second condition in which assembly unit 17 is not utilized.

To operate returnable container system 11 in said first condition, the user receives the container 13 from the chemical company with the chemicals L therein and with the container being sealed as heretofore described. With sleeve 275 in an unlatched position as shown in FIG. 2 and with locking members 231 of supporting means 199, Z01 in unlocked positions, the user then aligns the assembly unit 17 so that first and second attachment means 113, 267 are aligned and with the mouths 225, 255 in horizontal alignment with the clamp 123, the unit 17 is moved horizontally to receive the clamp 123 in mouths 225, 255 while at the same time slidably receiving the attachment means 113, 267 together. Then the sleeve 275 is moved downwardly to the second position thereof to lock the attachment means 113, 267 in place. The thumb nuts 251 of supporting means 199, 201 are turned in said first direction to cause the locking members 231 to move downwardly which in turn cause gripping and locking engagement with clamp 123 to lockably attach assembly unit 17 to container 13 and for the sole support of the assembly unit from the container.

Electricity is then supplied to motor 149 by suitable means well known to those skilled in the art, such as by a battery, wires, switch, etc., not shown, which causes piston rod 79 to reciprocate and move piston 63 upwardly and downwardly. On the downward stroke, it will be understood that the chemicals L in chamber 281 of pump means 41 will move upwardly through check valve 91 and passageways 103 to the top side of piston 63. It will be understood that during this downward stroke any fluid between the mid-portion 77 of piston 63 and housing 37 will be exhausted through the ports 283 in the housing. Then, on the upward stroke of piston 63 the chemicals L will be forced upwardly by the piston 63 through the interior passageway 49 in housing 37 and through the outlet 43 and conduit 51 to the point of use. Also, it will be understood that during the above-described upward stroke of piston 63 chemicals L will be drawn into chamber Z81 through the inlet 59.

If the user elects to use returnable container system 11 in said second condition as, for example, if the user has his own pump and counter means, he may do so without the use of assembly unit 17. In using system 11 without assembly unit 17, the user receives the container 13 just as the first-mentioned user in said first condition receives the container from the chemical company, that is, with chemicals L sealed in container 13 and with the drivable pump means 41 intact. However, it will be understood that the drivable pump means 41 will remain dormant in said second condition of use and the user connects his own independent pump and counter means, if desired, to the outlet 43 with suitable conduits, or the like, such as conduit 51. It will be understood that in the use of system 11 in said second condition, the liquid chemicals L will pass upwardly through inlet 59, chamber 28!, inlet 97, passageways 103, interior passageway 49 and out outlet 43.

From the foregoing. It will be understood that the chemical company only has to supply one returnable container to the user regardless of which of the two uses is made thereof. This is an advantage to the chemical company since two different types of containers do not have to be supplied. Then, as far as the user is concerned, he has the option of use in either said first o second conditions depending upon his situation.

Although the present invention has been described and illustrated with respect to a preferred embodiment and a preferred use therefor, it is not to be so limited since modifications and changes can be made therein which are within the full intended scope of the invention.

I claim:

1. A dual use returnable container system for optional uses in first and second conditions, said system comprising:

(a) a container having an interior for holding chemicals and the like, said container including a wall defining said interior;

(b) unbroken sealing means for sealing said container against access to the interior of said container unless said sealing means is broken;

(c) dispensing means for dispensing chemicals and the like from the interior of said container, said dispensing means including:

(i) housing means including an outlet means, said housing means having an interior passageway for chemicals and the like to flow from said interior of said container through said outlet means for the dispensing thereof:

(ii) one way valve means disposed in said housing means for permitting flow of chemicals and the like from said interior of said container into said passageway but preventing flow from said passageway into said interior of said container;

(iii) drivable pump means disposed in said housing means for pumping, when driven, chemicals and the like from said interior of said container, through said passageway and said outlet means, said pump means including a reciprocatable piston and a piston rod attached to said piston and extending upwardly through the upper end of said housing with the upper end of said piston rod being on the exterior of said container; and (d) an assembly unit including pump driving means for reciprocatably driving said drivable pump means when operably connected to said piston rod, and said unit including counter means operably connected to said pump driving means for indicating measured amounts of chemicals and the like dispensed from said container:

(e) means on the outside of said container for attaching said assembly unit to said dispensing means from the outside of said container without breaking said sealing means and without disassembling any parts of said assembly unit to place said system in said first condition in which said assembly unit is utilized to cause dispensing and measuring of the chemicals and the like from said container and for detaching said assembly unit from said dispensing means from the outside of said container without breaking said sealing means and without disassembling any parts of said assembly unit to place said system in a second condition in which an operator is free to use his own pumping and measuring system with said sealed container.

2. A returnable container system comprising:

(a) a container having an interior for holding chemicals and the like, said container including a wall defining said interior and having an opening therethrough, said container including a hollow neck portion surrounding said opening and upstanding from said wall, said neck portion having a flange at the upper end thereof;

(b) dispensing means for dispensing chemicals and the like from the interior of said container, said dispensing means including:

(i) housing means including an outlet means, said housing means having an interior passageway for chemicals and the like to flow therethrough from said interior of said container through said outlet means for the dispensing thereof, and said housing means including a flange adjacent the upper end thereof;

(ii) one way valve means disposed in said housing means for permitting flow of chemicals and the like from said interior of said container into said passageway but preventing flow from said passageway into said interior of said container; and (iii) drivable pump means disposed in said housing means for pumping, when driven, chemicals and the like from said interior of said container, through said passageway and said outlet means, said pump means including a reciprocatable piston and a piston rod having an upper end and a lower end, said piston rod being attached adjacent said lower end thereof to said piston and extending upwardly through the upper end of said housing means with said upper end of said piston rod being on the exterior of said housing means, said piston rod including first attachment means adjacent said upper end thereof;

(c) said dispensing means being removably mounted in said container with said flange of said housing means resting on said flange of said neck portion of said container;

(d) clamp means having an upper edge and a lower edge, said clamp means engaging said flange of said container and said flange of said housing to secure said dispensing means in said container;

(e) a removable assembly unit including pump driving means for reciprocatably driving said pump when operably connected to said piston rod; and (f) second attachment means for removably and operably attaching said pump driving means to said piston rod with said second attachment means engaging said first attachment means of said piston rod.

3. The returnable container system of claim 2 in which said pump driving means comprises, a piston rod extension having an upper end and a lower end, a gear housing, an electrical motor mounted on said gear housing and including a rotatably driven shaft, a first gear fixedly mounted on said shaft, a second gear rotatably mounted from said gear housing and meshing with said first gear for rotation of said second gear by said first gear, and connecting means for operably connecting the rotational movement of said second gear to said piston rod extension to cause said piston rod extension and said piston rod to reciprocate upwardly and downwardly.

4. The returnable container system of claim 3 in which said assembly unit includes at least one supporting means for supporting said assembly unit.

5. The returnable container system of claim 4 which includes a pair of said supporting means for supporting said assembly unit.

6. The returnable container system of claim 4 in which said supporting means includes a body member having an upper end and a lower end, means for attaching said body member to said pump driving means, a foot member attached to said body member adjacent said lower end thereof and including a foot portion extending laterally beneath said body member in spaced relationship thereto to provide a mouth, said body member having an interior therein opening downwardly through an opening into said mouth, a locking member movably mounted in said interior and having a lower portion extendable through said opening into said mouth, said mouth removably receiving said clamp means with said locking member contacting said upper edge of said clamp means and said foot portion contacting said lower edge of said clamp means, and adjustable wedging means for urging said locking member downwardly against said clamp means to grip said clamp means between said foot portion and said locking member.

7. The returnable container system of claim 6 in which said body member includes a bore extending therethrough and in communication with said interior adjacent said locking member, and in which said wedging means includes a threaded rod having threads adjacent one end thereof, said threaded rod including an angled surface disposed at an angle relative to the longitudinal axis of said threaded rod, said threaded rod having said threaded end thereof extending exteriorly of said body member and being slidably mounted in said bore for movement longitudinally therein between first and second positions, nut means threadedly engaging said threaded end exteriorly of said body member and turnable in a first direction for drawing said threaded rod longitudinally to cause said angled surface to exert a downward component of force against said locking member to lock said supporting means and turnable in a second direction to release said angled surface from said locking member to permit removal of said supporting means from said clamp means.

8. The returnable container system of claim 3 in which said first attachment means comprises a claw-like member extending transversely of said piston rod, said claw-like member including a projecting member and a slot in said piston rod below said projecting member; and in which said second attachment means includes a projecting member complementary in shape to said slot of said claw-like member and slidably movable laterally into an engaged position in said slot of said claw-like member and into a disengaged position out of said slot of said claw-like member, and a slot in said piston rod extension adjacent said lower end thereof above said projecting member of said second attachment means and complementary in shape to said projecting member of said claw-like member and slidably movable laterally into an engaged position over said projecting member of said claw-like member and into a disengaged position away from said projecting member of said claw-like member; a sleeve slidably mounted on said lower end of said piston rod extension, said sleeve being movable between a first position above said slot in said piston rod extension and a second position in overlapping relationship with said slot in said piston rod extension and in overlapping relationship with said projecting member of said claw-like member when said slot in said piston rod extension is in said engaged position therewithin; whereby when said projecting member of said second attachment means is in said engaged position in said slot of said claw-like member, said slot of said piston rod extension is in said engaged position over said projecting member of said claw-like member, and said sleeve is in said second position, said piston rod extension and said piston rod are locked together for conjoint movement.

9. The returnable container system of claim 7 in which said connecting means includes a cam attached to said second gear at a point spaced from the center of said second gear, a yoke attached to said piston rod extension at said upper end thereof, said yoke including an oblong inner path, bearing means interposed between said cam and said inner path for allowing said cam to move side to side relative to said yoke and to cause said yoke to move upwardly and downwardly as said second gear rotates.

10. The returnable container system of claim 8 which includes counter means operably coupled to said shaft for providing in combination with said dispensing means an indication of the amount of chemicals and the like dispensed from said container.

11. The returnable container system of claim 10 in which said counter means includes magnet means attached to said shaft for rotation therewith, reed switch means adjacent said magnet means for being actuated thereby as said shaft is rotated, and electronic digital counter means operably coupled to said reed switch means for indicating the amount of chemicals and the like dispensed from said container.

* * * * *